US012559286B2

(12) United States Patent
Illman

(10) Patent No.: US 12,559,286 B2
(45) Date of Patent: Feb. 24, 2026

(54) MODULAR CONTAINER

(71) Applicant: Dometic Sweden AB, Solna (SE)

(72) Inventor: Stanley Illman, Johannesburg (ZA)

(73) Assignee: Dometic Sweden AB, Solna (SE)

( * ) Notice: Subject to any disclaimer, the term of this patent is extended or adjusted under 35 U.S.C. 154(b) by 0 days.

(21) Appl. No.: 18/424,005

(22) Filed: Jan. 26, 2024

(65) Prior Publication Data

US 2024/0253861 A1 Aug. 1, 2024

Related U.S. Application Data

(60) Provisional application No. 63/482,354, filed on Jan. 31, 2023.

(51) Int. Cl.
*B65D 21/08* (2006.01)
*B65D 43/16* (2006.01)

(52) U.S. Cl.
CPC ..... *B65D 21/083* (2013.01); *B65D 43/163* (2013.01)

(58) Field of Classification Search
CPC ..... B65D 21/083; B65D 21/0209; B65D 11/1873; B65D 88/005
See application file for complete search history.

(56) References Cited

U.S. PATENT DOCUMENTS 3,749,273 A * 7/1973 Wreghitt ..... B65D 90/0006 220/1.5
5,120,480 A 6/1992 Anderson
5,890,613 A 4/1999 Williams
5,984,441 A 11/1999 Stokhuijzen
D465,330 S 11/2002 Parker
D467,424 S 12/2002 Hardigg et al.
D467,425 S 12/2002 Hardigg et al.
D467,426 S 12/2002 Hardigg et al.
D482,529 S 11/2003 Hardigg et al.
6,953,126 B2 10/2005 Parker et al.
6,955,381 B2 10/2005 Parker et al.
D523,242 S 6/2006 Hardigg et al.
7,533,782 B2 5/2009 Parker et al.
7,690,522 B2 * 4/2010 Rood ..... B65D 88/123 220/1.5
7,854,340 B1 12/2010 Baker et al.
8,443,496 B2 * 5/2013 De La Fuente .... A61G 17/0136 27/27
D810,432 S 2/2018 Ballou et al.
D810,433 S 2/2018 Ballou et al.
D811,084 S 2/2018 Ballou et al.
D811,742 S 3/2018 Ballou et al.
D811,744 S 3/2018 Ballou et al.
(Continued)

OTHER PUBLICATIONS

PCT Patent Application No. PCT/IB2024/050755 titled "Modular Container" filed on Jan. 26, 2024.
(Continued)

*Primary Examiner* — Shawn M Braden
(74) *Attorney, Agent, or Firm* — Dinsmore & Shohl LLP

(57) ABSTRACT

Present embodiments relate to a modular container. More specifically, but without limitation, present embodiments relate to a modular container which may be varied in size in order to change the size and storage capacity of the container. The modular container may comprise latch and expansion structures to increase or decrease the size and capacity of the container.

15 Claims, 7 Drawing Sheets

(56) References Cited

U.S. PATENT DOCUMENTS

| | | | | |
|---|---|---|---|---|
| 11,434,049 | B2 * | 9/2022 | Ager | B65D 37/00 |
| 2005/0001435 | A1 | 1/2005 | Parker et al. | |
| 2009/0120835 | A1 | 5/2009 | Ublacker et al. | |
| 2010/0116822 | A1 * | 5/2010 | Perelli | B65F 1/0053 220/4.03 |
| 2013/0228583 | A1 * | 9/2013 | Mayer | B65D 81/3862 220/666 |

OTHER PUBLICATIONS

U.S. Appl. No. 63/482,354 titled "Modular Container" filed Jan. 31, 2023.
Internationl Search Report & Written Opinion for Application No. PCT/IB2024/050755 mailed on Apr. 9, 2024.
South African Patent Application No. 2025/06246 titled "Modular Container" filed on Jul. 23, 2025.
AU Patent Application No. 2024213456 titled "Modular Container" filed on Apr. 14, 2025.
EP Patent Application No. 24703242.8 titled "Modular Container" filed on May 2, 2025.

* cited by examiner

MODULAR CONTAINER

CLAIM TO PRIORITY

This non-provisional patent application claims priority to and benefit of, under 35 U.S.C. § 119(e), U.S. Provisional Patent Application Ser. No. 63/482,354, filed Jan. 31, 2023 and titled "Modular Container", all of which is incorporated by reference herein.

BACKGROUND

1. Field of the Invention

Present embodiments relate to a modular container. More specifically, but without limitation, present embodiments relate to a modular container which may be varied in size in order to change the size and storage capacity of the container.

2. Description of the Related Art

Hard containers are useful for storage during trips or in fixed storage areas such as warehouses, garages, or other designated storage facilities. However, w an amount of storage materials does not match a size of a container, either additional storage containers must be used, or space within a container goes unused which wastes space in the storage container.

Additionally, when shipping containers, for example after manufacturing and/or following a sale, the assembled containers are typically empty. This means the containers take up room and are not generally efficient from a cost, volume, and shipping perspective to move from one location to another.

It would be desirable to overcome these and other deficiencies and provide a hard storage container which may be varied in size and shape depending on the amount of materials needing to be stored. Additionally, it would be desirable to provide a container more easily shipped in a cost effective manner.

The information included in this Background section of the specification, including any references cited herein and any description or discussion thereof, is included for technical reference purposes only and is not to be regarded as subject matter by which the scope of the claims are to be bound.

SUMMARY

The present application discloses one or more of the features recited in the appended claims and/or the following features which alone or in any combination, may comprise patentable subject matter.

The present embodiments provide a modular container which may be expanded to a larger size if needed, or reduced in size if a smaller container is needed. The storage container provides a plurality of components that allow for expansion to a large size. The container comprises a lid and a base wherein the lid and the base comprise end modules, latch modules, and intermediate expansion modules, all of which allow for expansion and reduction in size to vary the size and capacity of the container.

According to some embodiments, a modular container may comprise a base and a lid connected to the base, the base may comprise a first end module, a second end module, one or more intermediate expansion modules disposed between the first end module and the second end module. Two or more latch modules may have a part in the base and a part in the lid. The base may be varied in shape by changing the one or more intermediate expansion modules and number of two or more latch modules.

In some embodiments, the modular container may further comprise an end surface at each end of the one or more intermediate expansion modules and flanges at ends of the two or more latch modules.

In some embodiments the modular container may further comprise an end surface disposed on the end modules which are configured to align with the end surface of each of the one or more intermediate expansion modules or a flange of the two or more latch modules.

In some embodiments, the modular container may further comprise a strengthening member which is disposed between the first and second end modules, the two or more latch modules, and the end modules.

In some embodiments, the modular container has one more the latch module than the intermediate module.

In some embodiments, each of the two or more latch modules having a flange which extends outwardly and creates a recess for positioning and operation of a latch.

In some embodiments, the latch may close or open the lid from the base.

In some embodiments, each of the flange may comprise an alignment pin.

In some embodiments, the one or more intermediate modules and one of the two or more latch modules may be removable for connection of each end module directly to a remaining latch module of the two or more latch modules.

In some embodiments the modular container may further comprise one or more connections on each of the two or more latch modules wherein the modular container is capable of being connected to a rack of a vehicle.

In some embodiments, the modular container may further comprise a rack alignment guide on a bottom surface of each of the two or more latch modules.

In some embodiments, the first and second end modules may have recesses that define hand grips at an upper end.

In some embodiments, the lid may having a domed shape.

In some embodiments, the lid may be hingedly or removably connected to the base.

According to some embodiments, a modular container may comprise a base and a lid connected to the base, a first end module forming a portion of the base and a portion of the lid, a second end module forming a second portion of the base and a second portion of the lid, a latch module that is connectable between the first and second end modules, the latch module having a lid portion that is connected to the portion of the lid of the first end module and the second end module, the latch module having a base portion that is connected to the portion of the base of the first end module and the second portion of the base of the second end module, and, wherein a volume of the modular container may be increased by adding an intermediate module and a second latch module.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. All of the above outlined features are to be understood as exemplary only and many more features and objectives of the various embodiments may be gleaned from the disclosure herein. Therefore, no limiting interpretation of this summary is to be understood without further reading of the entire specification, claims and drawings, included herewith. A more extensive presentation of features, details, utilities, and advantages is provided in the following written description of various embodiments, illustrated in the accompanying drawings, and defined in the appended claims.

BRIEF DESCRIPTION OF THE DRAWINGS

In order that the embodiments may be better understood, embodiments of a modular container will now be described by way of examples. These embodiments are not to limit the scope of the claims as other embodiments of a modular container will become apparent to one having ordinary skill in the art upon reading the instant description. Non-limiting examples of the present embodiments are shown in figures wherein:

DETAILED DESCRIPTION

Figure 2:
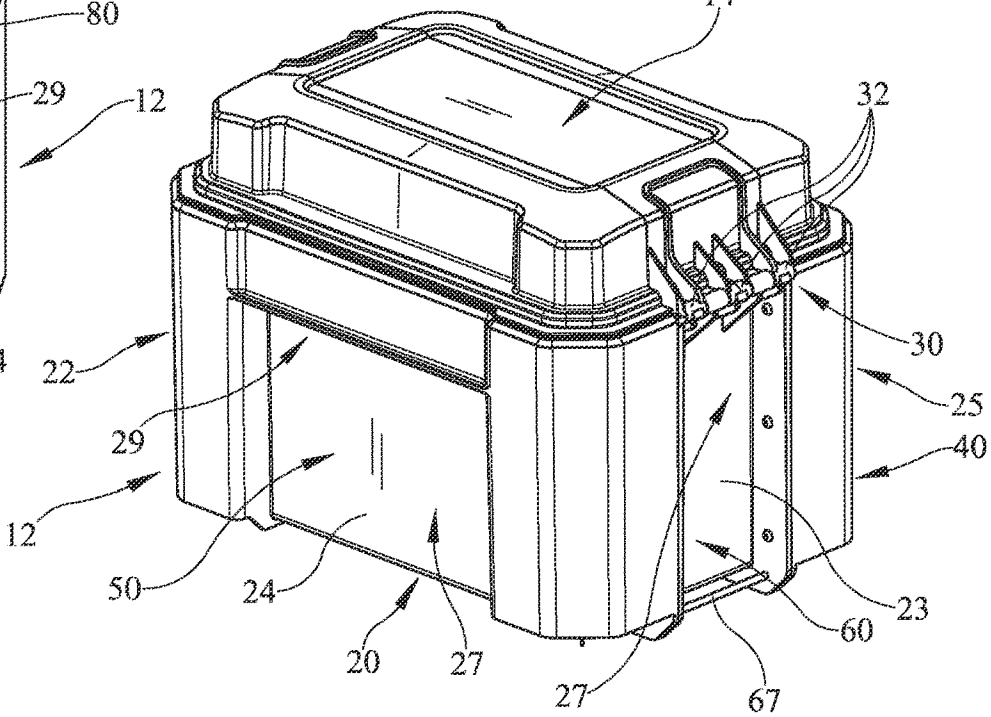
FIG. 2 is a second perspective view of the modular container of FIG. 1 in an alternate orientation.

It is to be understood that a modular container is not limited in its application to the details of construction and the arrangement of components set forth in the following description or illustrated in the drawings. The described embodiments are capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Referring now to FIGS. 1-9, various embodiments of a modular container are provided. The various embodiments are shown in a smaller size initially and then shown with one or more intermediate expansion modules and latch modules to show and describe how the device is capable of expanding in size and volume. The modular container allows for shipping of the container in a disassembled manner, which results in improved cost efficiency during shipping from a manufacturer and/or to an end user. Additionally, the modularity allows for selection by the end user of a size that is needed and assembly/disassembly to a desired size needed for containment of goods.

Figure 1:
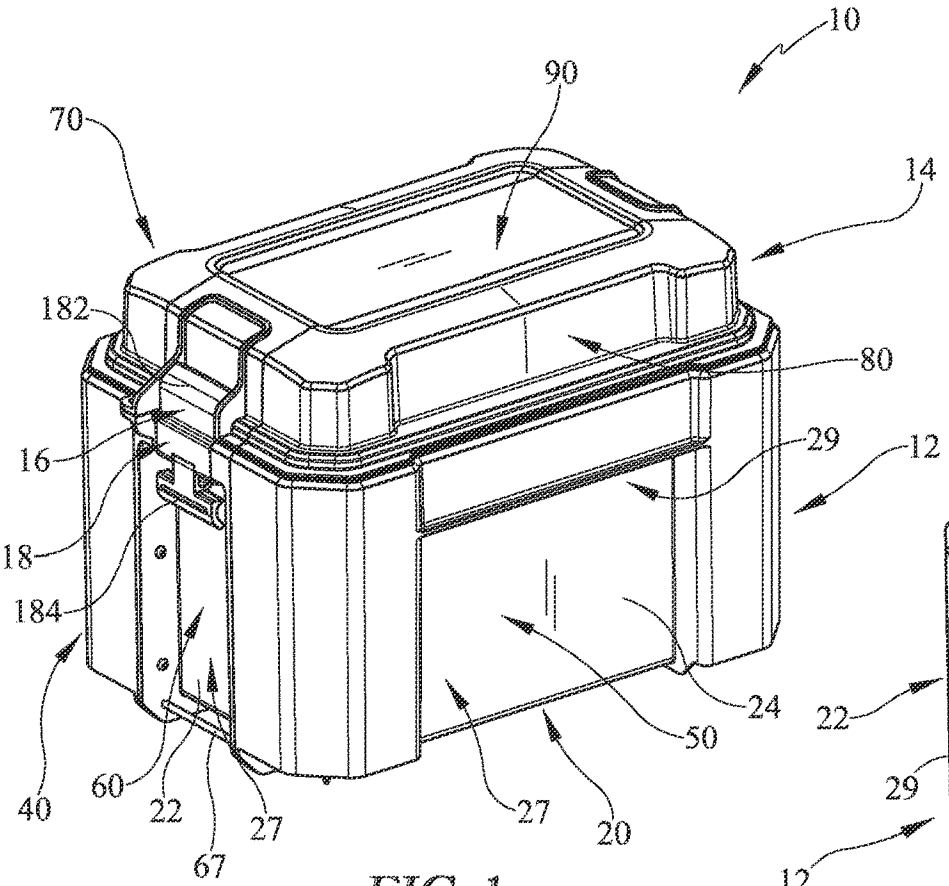
FIG. 1 is a first perspective view of an embodiment of a modular container in an orientation.

Referring now to FIG. 1, a first perspective view of a modular container 10 is shown. The view is a front upper perspective view. The modular container 10 comprises a base 12 and a lid 14, wherein the lid 14 is hingedly connected to the base 12. The modular container 10 is shown in a closed configuration and may be closed by various closing mechanisms 16. In some embodiments, such as that depicted, a latch 18 may be utilized to close the lid 14 on to the base 12. However, this is merely one embodiment and others may be within the scope of the present claims.

The container base 12 comprises a bottom 20 and a plurality of walls 22, 23, 24, 25 that extend from the bottom 20 and to which the lid 14 is connected. The lid 14 may cover the peripheral upper edges of the walls 22 when closed, as shown. In the depicted embodiment, the front of the modular container 10 comprises the closing mechanism 16. The rear of the container module, shown in FIG. 2, comprises a hinge 30 that is located opposite the closing mechanism 16.

The lid 14, according to some embodiments, may comprise a domed shape that is raised to add to the height of the modular container 10. The dome shaped lid 14 may provide additional height within the modular container, to provide additional storage capacity, as opposed to a flat lid. Alternately, however, the lid 14 need not be domed.

With reference now to the base 12, in the depicted embodiment the base 12 comprises a first end module 40, a second end module 50, and a latch module 60. The modules are shown assembled, and may be fastened together for example. The latch module 60 is disposed between the first end module 40 and the second end module 50 and extends generally between the front and the rear of the modular container 10. The latch modules 60 and first and second end modules 40, 50 are assembled together by fasteners but the fasteners may be removed to disassemble the latch module 60 and end modules 40, 50. The latch module 60 may be engaged by the closing mechanism 16, for example the latch 18. Additionally, the latch module 60 in some embodiments may provide hinge functionality with the lid 14, as will be described further herein. In other embodiments, the latch module may allow for removal of the lid.

Likewise, the lid 14 may comprise a first end module 70, a second end module 80, and a latch module 90. The modules of the lid 14 may be assembled as well, for example by fasteners and the latch module 60 connects the lid 14 to the base 12 for pivoting movement of the lid 14 from the closed position depicted to an open position.

The lid 14 and base 12, and the related modules, may be formed of hard plastics. For example, the modules may be molded in various manners and may be formed of various materials, including but not limited to, rotational molded, blow molded, or injection molded materials, among others. Exemplary materials for forming the modular container 10 include polyethylene, linear low-density polyethylene (LLDPE), low-density polyethylene (LDPE), high density polyethylene (HDPE), cross-linked polymers or polyethylene, polyvinyl chloride (PVC), nylon, polypropylene, polycarbonate, thermoplastic polyester polymers, regrind, and PVC plastisols, or any combination thereof, among others. Further, it may be desirable to combine any of the above materials with certain additives, such as colorants, anti-static agents, cross-linking agents, flame retardants, flow modifiers, foaming agents, heat stabilizers, impact modifiers, or UV stabilizers, among others.

Additionally, the walls 22-25 of the base 12 and the lid 14 may be single walled, or may be double walled, and may or may not be insulated. For example, if a double walled container is manufactured and it is desired to be insulated, a foam, for non-limiting example polyurethane, may be used between the outer and inner walls or shells.

Referring now to FIG. 2, a rear perspective view of the container 10 is depicted wherein the hinge 30 is shown. The hinge 30 is located on the latch modules 60, 90 and connects the base 12 and the lid 14. The lid end modules 70, 80 are connected to the lid latch module 60, for example by fasteners, and the entire lid 14 is pivotally connected to the base 12 by the hinge 30 of the latch module 60.

As additionally shown in the views of FIGS. 1 and 2, the walls of the base 12 may have recesses 27 which allow for formation of a hand grip area 29 near the top of the base 12. The recesses 27 also allow for formation of an edge where the latch module 60 of the base 12 may be connected.

Figure 9:
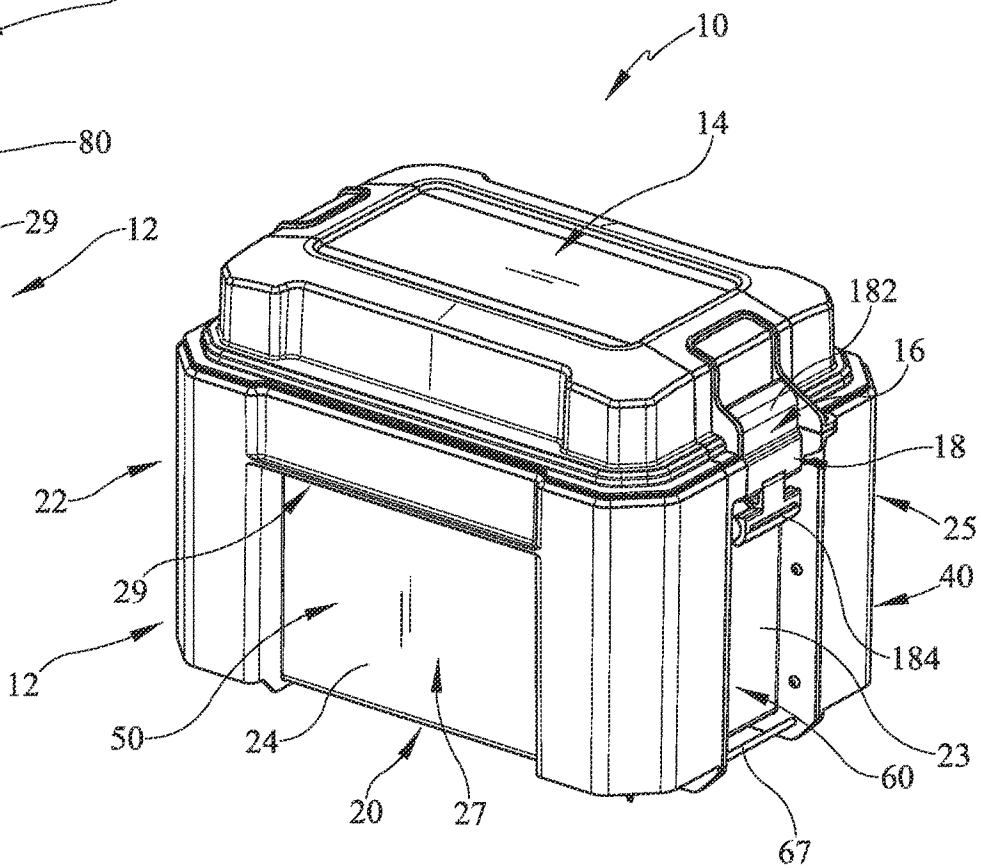
Figure 8:
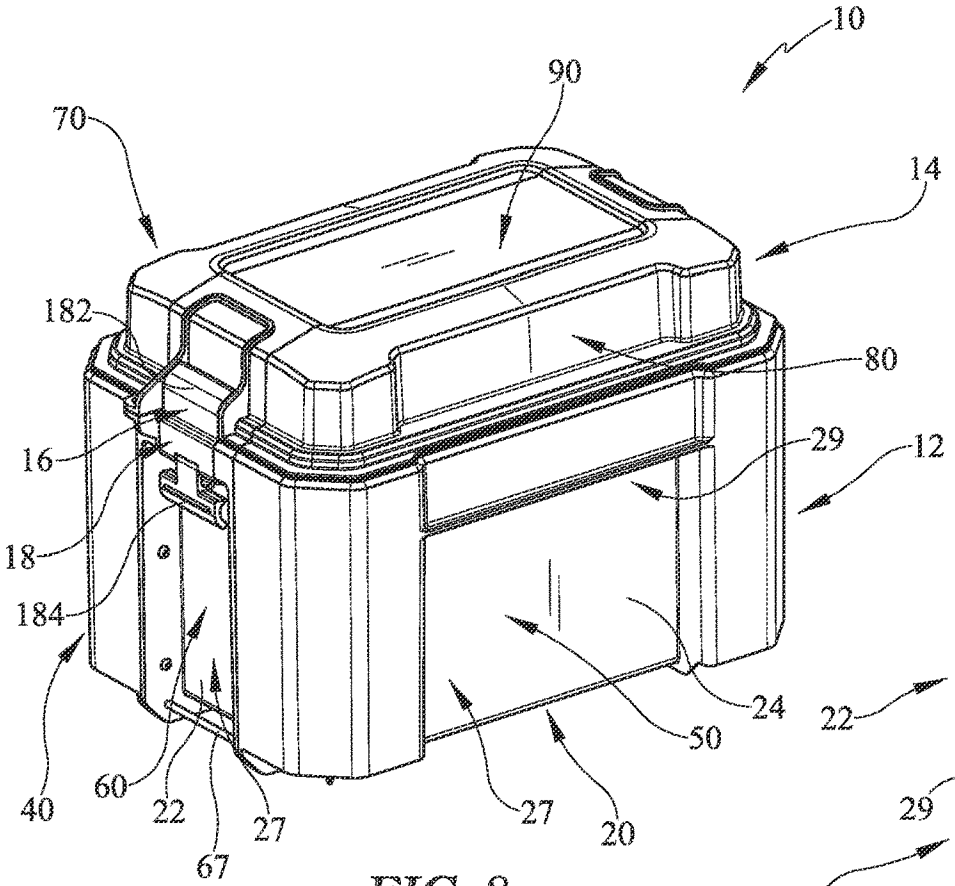
FIG. 8 is a perspective view of an alternative modular container of FIG. 1, with a removable lid in an orientation; and, FIG. 9 is a rear perspective view of the modular container of FIG. 8 in an alternate orientation.

The hinge 30 may be formed of a plurality of interlocking fingers 32 which extend from both of the lid 14 and the base 12. A hinge pin or other interlocking structure may be used to join the fingers 32 of the lid 14 and base 12 where the fingers 32 engage. However, a hinge 30 need not be utilized. For example, closing mechanisms 16 may be used at opposite sides of the modular container 10, so that the lid 14 is completely removable from the base 12 upon unlocking both closing mechanisms 16, as shown in FIGS. 8 and 9.

Figure 3:
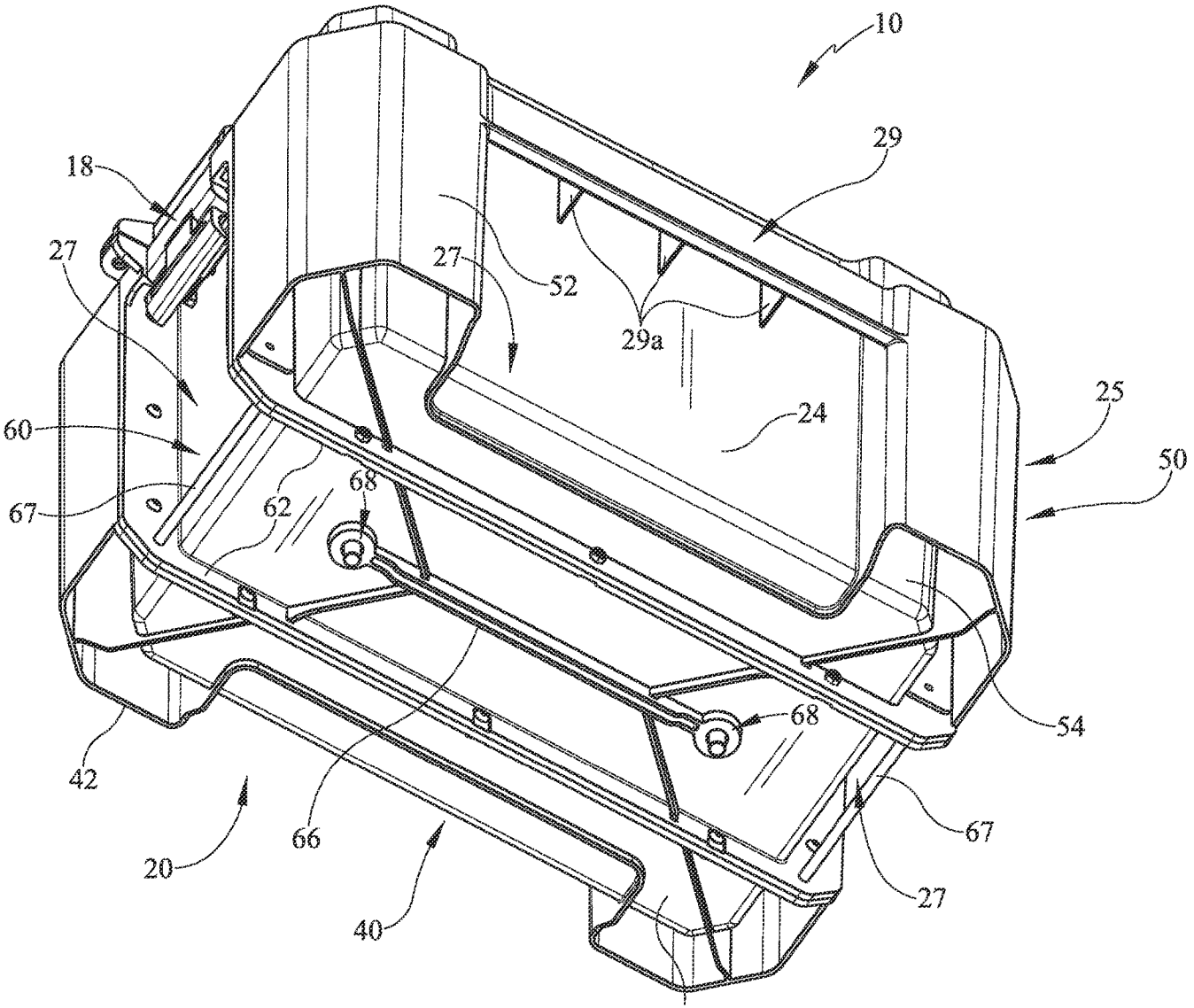
FIG. 3 is a lower perspective view of the modular container of FIG. 1.

With reference to FIG. 3, a lower perspective view of the modular container 10 of FIGS. 1 and 2 is shown. The lower perspective view shows an embodiment with double walls formed on the end modules 40, 50. Outer walls or shells 42, 52 are shown with an open bottom also depicting inner shells 44, 54. Corners of the outer shells 42, 52 are larger than the inner shell 44, 54 in the corner areas, creating a space therebetween. This area may be filled with insulation, for example, foam, air, gas, or other insulating material. Additionally, the area may be opened as shown, or may be closed by adding a bottom surface to the outer shell 42, 52.

Additionally, as shown in FIG. 3, the recess 27 is formed in the outer walls 24, 25 between the corner areas of the first and second end modules 40, 50. The hand grab 29 is formed extending from one corner to the other, in the front to rear direction for example of each end module 40, 50. The hand grab 29 may be molded and may comprise one or more strengthening ribs 29*a* extending between the grab and the outer surface.

Further, as shown in FIG. 3, the bottom surface of the modular container 10 is also shown having alignment guides 66. The guides 66 may be used with structure on a vehicle rack, which allows for alignment with the rack and therefore attachment of the container to the rack. The rack may be, for example but without limitation, a roof rack, bed rack, or tow hitch carrier, among others.

Further, the bottom 20 may comprise connection points 68 for connection to a roof rack, for example. The connection points 68 may also function as drains for example if ice is used to keep contents within the container cool, and the ice melts. The drains allows for removal of such water or other spilled liquid within the modular container 10.

Also shown in the lower perspective view of FIG. 3, as well as the previous views, the flanges 62 of the latch module 60 and the end modules 40, 50 not only extend vertically along the walls 22, 23, but also extend horizontally along the bottom 20 of the modular container 10. The guide 66 and the flanges 62 both extend, according to some embodiments, in the front to rear direction of the container 10, that is from the latch 18 end to the hinge 30 end. However, other orientations may be used.

Figure 4:
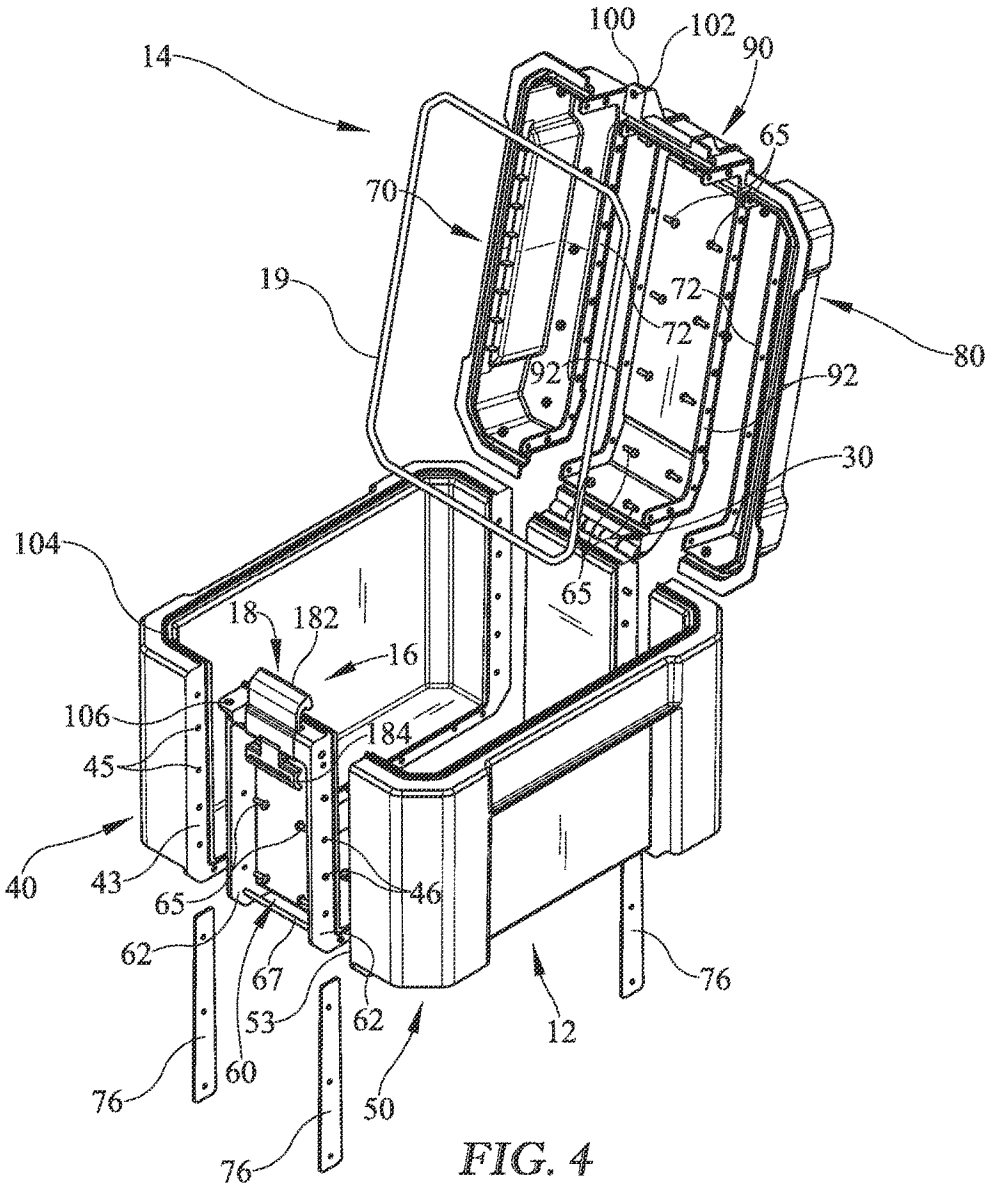
FIG. 4 is an exploded perspective view of the modular container of FIG. 1.

As shown in FIG. 4, an exploded perspective view of the modular container 10 is depicted. The lid 14 is shown opened relative to the base 12. The first and second end modules 40, 50, 70, 80 and the latch modules 60, 90 are shown spaced from one another. The spacing of the modules 40, 50, 70, 80, 60, 90 allows for explanation of the connections therebetween. As previously described, the corner areas of the first and second end modules 40, 50 have an outer shell 42, 52 that is enlarged and provides for creation of a surface 43, 53 for fastening. More specifically, these surfaces 43, 53 comprise an area which allows for connection to the flanges 62 of the latch module 60. Further, fasteners 65 may extend between the latch module 60 and the end modules 40, 50 through the flanges 62 of the latch module 60 and into end surfaces 43, 53 of the end modules 40, 50. The end surfaces 43, 53 also may define flanges but the terms are varied for purpose of clarity of description. In some embodiments, the end surfaces 43, 53 may comprise one or more holes 45 or one or more alignment pins or dowels 65, while the opposite flange 62 may comprise the other of the holes 46 or the dowels/pins 65. This provides alignment and retention aid between the adjacent parts.

Additionally, as noted before the end modules 40, 50 and the latch module 60 may be formed of, among other materials, molded plastic. Since the containers may be carrying heavy loads, it may be desirable to also provide strengthening ribs or plate 76. Such strengthening rib 76 may be disposed between the flanges 62 of the latch modules and the end surfaces 43, 53 of the end modules 40, 50 where the modules are fastened together. The strengthening ribs 76 may provide strengthening characteristics and rigidity, as well as provide additional structure to capture the fasteners 65. For example, the strengthening ribs or plates 76 may be nut plates that provide threaded engagement with the fasteners 65. The fasteners 65 may also threadably engage the end modules 40, 50.

The strengthening plates 76 are all shown in a vertical orientation between the flanges of the latch modules and the ends of the end modules. Additionally however, strengthening ribs 76 may also be oriented between the horizontal extending portions of the flanges 62 of the latch modules 60 and horizontal flanges of the end modules 40, 50 along the bottom 20.

As shown at the rear of the lid 14 and the base 12, the latch module 60, comprises the hinge 30 that allows pivoting interlock of the lid 14 and the base 12 for opening and closing of the lid 14. Surfaces 72 of the end modules 70, 80 of the lid 14 are fastened to flanges 92 of the lid portion of the latch module 60. With this connection of the lid end modules 70, 80 and the lid latch module 90, the lid 14 may be pivotally opened as a single structure.

A lid gasket 19 is also shown disposed exploded from the lid 14, but may be located in the lid 14 or in the base 12 for engagement with both when the lid 14 is in the closed position. This precludes water and dirt contaminants from entering the modular container 10 when the lid is closed.

Also shown on at the front of the lid 14, a locking protuberance 100 is shown with a hole 102 extending through. The hole 102 in the locking protuberance 100 of the lid 14, aligns with a hole 106 in a protuberance 104 of the base 12, so that when the lid 14 is closed, a keylock, padlock, or other locking member may be placed through both holes and locked.

In this view, the closing mechanism 16 is shown as a latch 18 and is disconnected from the open lid. The latch 18 may comprise an upper catch 182 which engages the lid 14 to retain the lid 14 in position. The lower portion of the latch 18 may comprise a handle 184 which pivots to cause a downforce from the upper catch 182 on the handle 184. While a hinge 30 is shown at the opposite side of the modular container 10, in some embodiments, a second closing mechanism 16 may be utilized at the opposite side of the container 10 to replace the hinge 30 and provide a completely removable lid 14 rather than a hinging lid, as shown in FIGS. 8 and 9.

Figure 5:
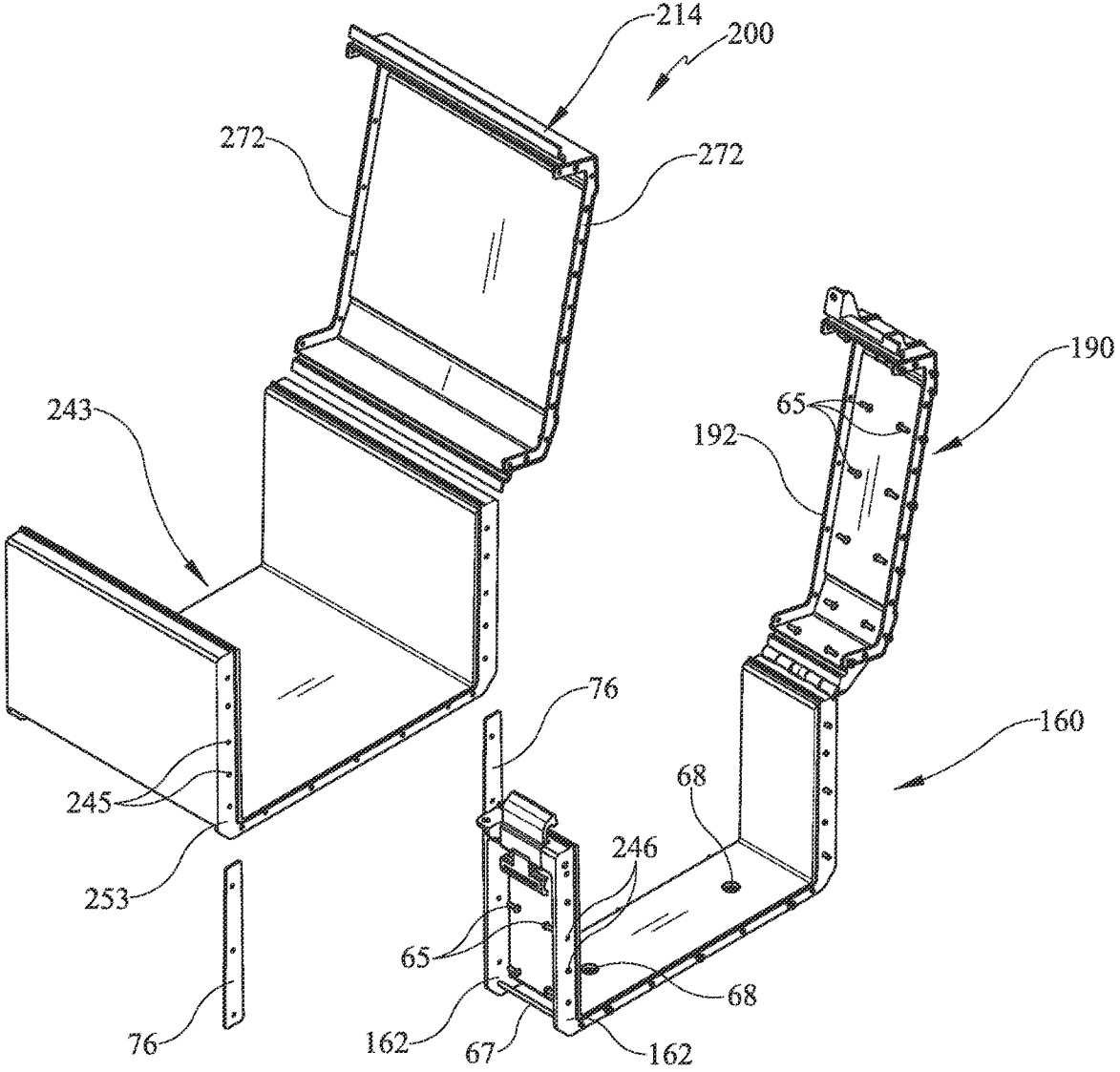
FIG. 5 is an exploded perspective view of an intermediate expansion module and a latch module which may be used to expand the size of the modular container.

With reference now to FIG. 5, an exploded perspective view of an intermediate module 200 and a latch module 160 are shown. In the previous views, the modular container 10 has been of a small size for purpose of initial explanation. However, the modular container 10 provides for modularity so that the container size may be easily expanded if needed. The latch module 160 is the same as the latch module 60 and such description will not be repeated. However, the use of the intermediate module 200 provides opportunity for the additional latch module 160. These modules 160, 200 increase the width of the modular container across the front surface.

The expansion of the container 10 is provided by the addition of the intermediate module 200 and an additional latch module 160. In some embodiments, there is one additional latch module than intermediate expansion module 200. For example, there may be two latch modules 60, 160 if one interchangeable expansion module 200. The view of FIG. 5 shows that the intermediate module 200 comprises end surfaces 243, 253 similar to the end modules 40, 50, which each may have a plurality of fastener apertures. The end surfaces 243, 253 of the intermediate module 200, and holes 245 therein, align with the flanges 62, 162 of the latch modules 60, 160 and the corresponding holes 246 therein. Accordingly, the intermediate portion 200 and the latch module 160 may be joined together by fasteners in a manner similar to that previously described. Additionally, the strengthening ribs 76 may be utilized between the modules being joined to provide improved fastening, rigidity, and strength.

Likewise, the lid 214 of the intermediate module 200 is fastened to the lid portion 90, 190 of the latch modules 60, 160. Accordingly, when the lid portions 90, 190 is pivoted open, the lid 214 of the intermediate portion 200 also pivots open. Flanges 92, 192 and end surfaces 272 of these structures may be utilized to connect to define the lid 90.

Finally, in this open view, the drains 68 of the latch module 60, 160 may also be seen from the interior. These holes 68 may also be used for connection to a rack or other fastening structure to maintain position of the modular container 210.

With reference to both FIGS. 4 and 5, the modular container may also comprise a plurality of restraints or tie-downs 67. The restraints 67 are shown as cylindrical structures that extend across the latch modules 60, 160 and between the flanges 62. The plurality of restraints 67 may add some rigidity to the modular container 10 and specifically the latch modules 60. Further however, the plurality of restraints 67 also may be used to tie down the modular container 10 to a rack, for example a roof rack.

Figure 6:
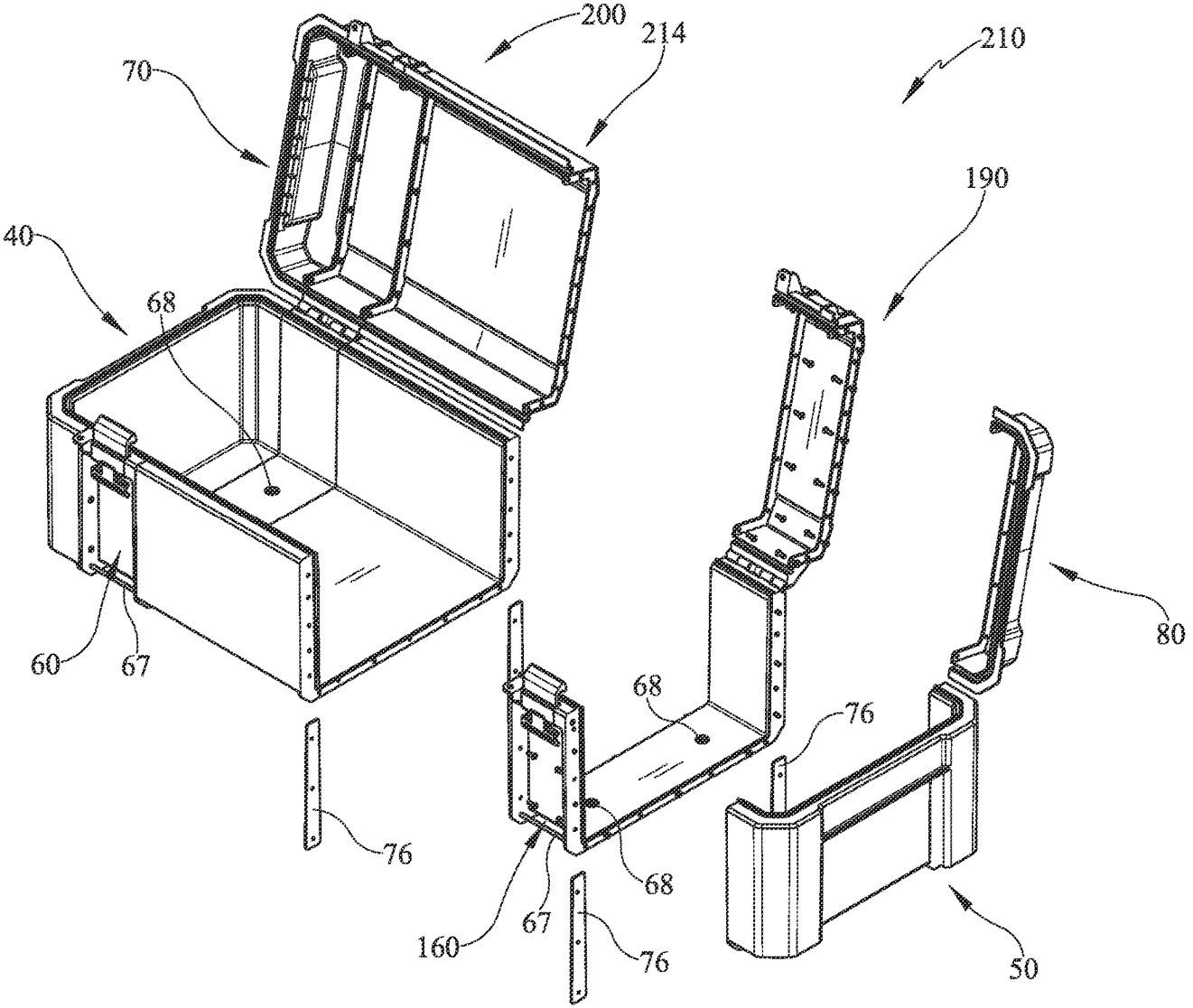
FIG. 6 is a partially exploded view of an expanded modular container.

Referring now to FIG. 6, a partially exploded perspective view of another modular container 210 is shown. The modular container 210 is shown having two end modules 40, 50, two latch modules 60, 160 and an intermediate expansion module 200. Accordingly, the size and volume of the modular container 210 of FIG. 6 is larger than the embodiments of FIGS. 1-4. As noted previously, and shown here, a modular container may have one additional latch module than intermediate expansion module. In the first embodiment, there is no expansion module and one latch module. In the instant embodiment, there is a single expansion module 200 and two latch modules 60, 160. When an intermediate expansion module is utilized, the latch modules may be connected at lateral ends of such expansion module.

Figure 7:
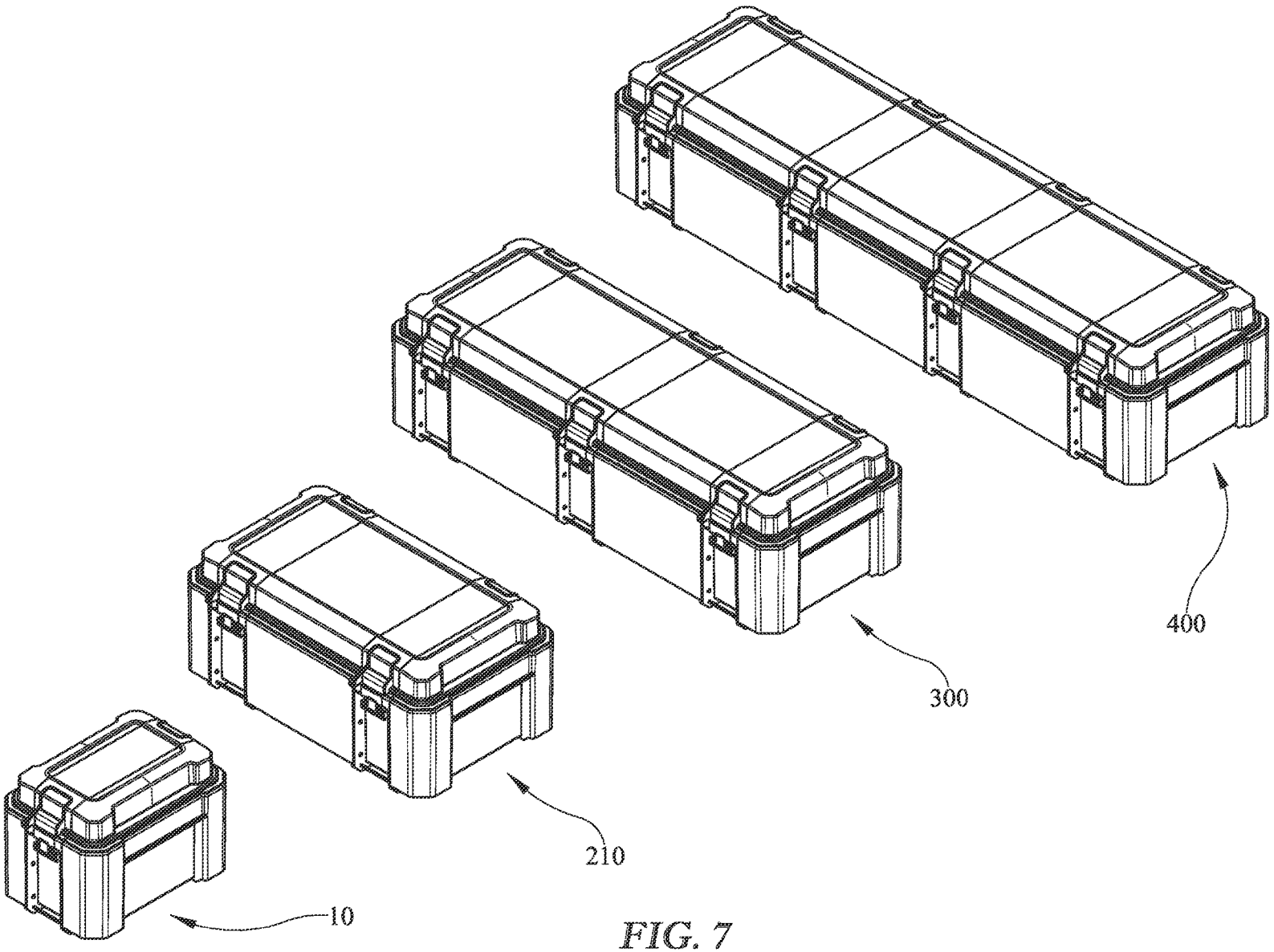
FIG. 7 is a perspective view of various modular containers which show the capability to expand the modular container to various sizes.

Referring now to FIG. 7, there are several modular containers of varying size. Starting from the bottom left of the figure, there is the modular container 10 of the first embodiment. Moving to the upper right, there is the modular container 210 embodiment of FIG. 6, which is larger than the first embodiment 10. Still further, the next embodiment shows a larger modular container 300. In this version, there are two expansion modules and three latch modules. Again, one additional latch module than expansion module. Still further, moving to the upper right, there is an even larger modular container 400. This embodiment provides a container having three expansion modules and four latch modules. In the examples, the modular containers 10, 210, 300, 400 may range in volume from about 15 liters to about 150 liters. These sizes are not limiting as they may vary with changes in dimension, but are merely exemplary of the variation that may be provided by the modularity.

Additionally, the structures may be manufactured as various individual modules and pieces, then shipped unassembled. This allows for much less wasted space as compared to shipping fully constructed containers which are all empty but take up large amounts of space.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

Unless otherwise indicated, all numbers expressing quantities of ingredients, properties such as reaction conditions, and so forth used in the specification and claims are to be understood as being modified in all instances by the term "about". Accordingly, unless indicated to the contrary, the numerical parameters set forth in this specification and claims are approximations that can vary depending upon the desired properties sought to be obtained by the presently-disclosed subject matter.

As used herein, the term "about," when referring to a value or to an amount of mass, weight, time, volume, concentration or percentage is meant to encompass variations of in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed method.

As used herein, ranges can be expressed as from "about" one particular value, and/or to "about" another particular value. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

The foregoing description of methods and embodiments has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A modular container, comprising:

a base and a lid hingedly connected to said base;

said base comprising:

a first end module;

a second end module;

one or more intermediate expansion modules disposed between said first end module and said second end module;

two or more latch modules, each of said two or more latch modules having a part in said base and a part in said lid;

each of said intermediate expansion module and each said part of each said latch module being U-shaped in section, and wherein said lid is hingedly connected to said base at said latch modules;

wherein said base may be varied in shape by changing said one or more intermediate expansion modules and number of said two or more latch modules.

2. The modular container of claim 1, further comprising an end surface at each end of said one or more intermediate expansion modules and flanges at ends of said two or more latch modules.

3. The modular container of claim 2, further comprising an end surface disposed on said end modules which are configured to align with said end surface of each of said one or more intermediate expansion modules or a flange of said two or more latch modules.

4. The modular container of claim 3, further comprising a strengthening member which is disposed between either of said first and second end modules and either of said two or more latch modules.

5. The modular container of claim 1, wherein said modular container has one more latch module of said two or more latch modules than said one or more intermediate expansion modules.

6. The modular container of claim 1, each of said two or more latch modules having a flange which extends outwardly and creates a recess for positioning and operation of a latch.

7. The modular container of claim 6, said latch closing or opening said lid from said base.

8. The modular container of claim 6, each of said flange comprising an alignment pin.

9. The modular container of claim 1, wherein said one or more intermediate expansion modules and one of said two or more latch modules are removable for connection of each end module directly to a remaining latch module of said two or more latch modules.

10. The modular container of claim 1, further comprising one or more connections on each of said two or more latch modules wherein said modular container is capable of being connected to a rack of a vehicle.

11. The modular container of claim 10, further comprising a rack alignment guide on a bottom surface of each of said two or more latch modules.

12. The modular container of claim 1, said first and second end modules having recesses that define hand grips at an upper end.

13. The modular container of claim 1, said lid having a domed shape.

14. The modular container of claim 1, wherein said lid is hingedly or removably connected to said base.

15. A modular container, comprising:

a base and a lid hingedly connected to said base;

a first end module forming a portion of said base and a portion of said lid;

a second end module forming a second portion of said base and a second portion of said lid;

a latch module that is connectable between said first and second end modules;

said latch module having a lid portion that is connected to said portion of said lid of said first end module and said second end module;

said latch module having a base portion that is connected to said portion of said base of said first end module and said second portion of said base of said second end module;

wherein an interior volume of said modular container is open between said first end module and said second end module and said interior volume may be increased by adding an intermediate module and a second latch module.

* * * * *